US005466570A

United States Patent [19]

Jagannathan et al.

[11] Patent Number: 5,466,570

[45] Date of Patent: Nov. 14, 1995

[54] SONIC MICRO REACTION ZONES IN SILVER HALIDE EMULSION PRECIPITATION PROCESS

[75] Inventors: Seshadri Jagannathan, Rochester; David F. Mahar, Avon; Rajendrakumar V. Mehta, Rochester, all of N.Y.

[73] Assignee: Eastman Kodak Company, Rochester, N.Y.

[21] Appl. No.: 391,747

[22] Filed: Feb. 21, 1995

[51] Int. Cl.[6] ..... G03C 1/015; G03C 1/025; B01F 11/02

[52] U.S. Cl. ..... 430/569; 366/118; 366/120

[58] Field of Search ..... 430/569; 366/118, 366/120

[56] References Cited

U.S. PATENT DOCUMENTS

| | | | |
|---|---|---|---|
| 2,876,083 | 3/1956 | Prietl | 23/295 R |
| 3,628,959 | 12/1971 | Theilemann | 430/569 |
| 3,680,462 | 8/1972 | Cronig | 354/317 |
| 3,887,597 | 6/1975 | Ohkubo et al. | 260/414 |
| 4,120,728 | 10/1978 | Ikenoue et al. | 430/618 |
| 4,171,224 | 10/1979 | Verhille et al. | 430/569 |
| 4,258,129 | 3/1981 | Ikenoue et al. | 430/620 |
| 4,260,677 | 4/1981 | Winslow et al. | 430/618 |
| 4,264,725 | 4/1981 | Reeves | 430/619 |
| 4,289,733 | 9/1981 | Saito et al. | 422/227 |
| 4,725,534 | 2/1988 | Kagami et al. | 430/619 |
| 4,871,647 | 10/1989 | Komamura et al. | 430/201 |
| 4,930,898 | 6/1990 | Miller-Ihli | 366/118 |
| 5,035,991 | 7/1991 | Ichikawa et al. | 430/569 |
| 5,055,537 | 10/1991 | Kawata et al. | 526/240 |
| 5,102,732 | 4/1992 | Goto et al. | 428/329 |

FOREIGN PATENT DOCUMENTS

| | | | |
|---|---|---|---|
| 1611432 | 12/1990 | U.S.S.R. | 366/118 |

*Primary Examiner*—Charles L. Bowers, Jr.
*Assistant Examiner*—Mark F. Huff
*Attorney, Agent, or Firm*—Carl F. Ruoff; Arthur H. Rosenstein

[57] ABSTRACT

The present invention is a method for producing a silver halide emulsion. The precipitation of the emulsion is carried out away from the rotary agitator. The reactant solutions are introduced into the reactor very close to the tip of one or more ultrasonic horns that are placed away from the agitator. The ultrasonic horns are efficient sources for controlling micromixing, while the agitator controls the macromixing in the reactor.

4 Claims, 1 Drawing Sheet

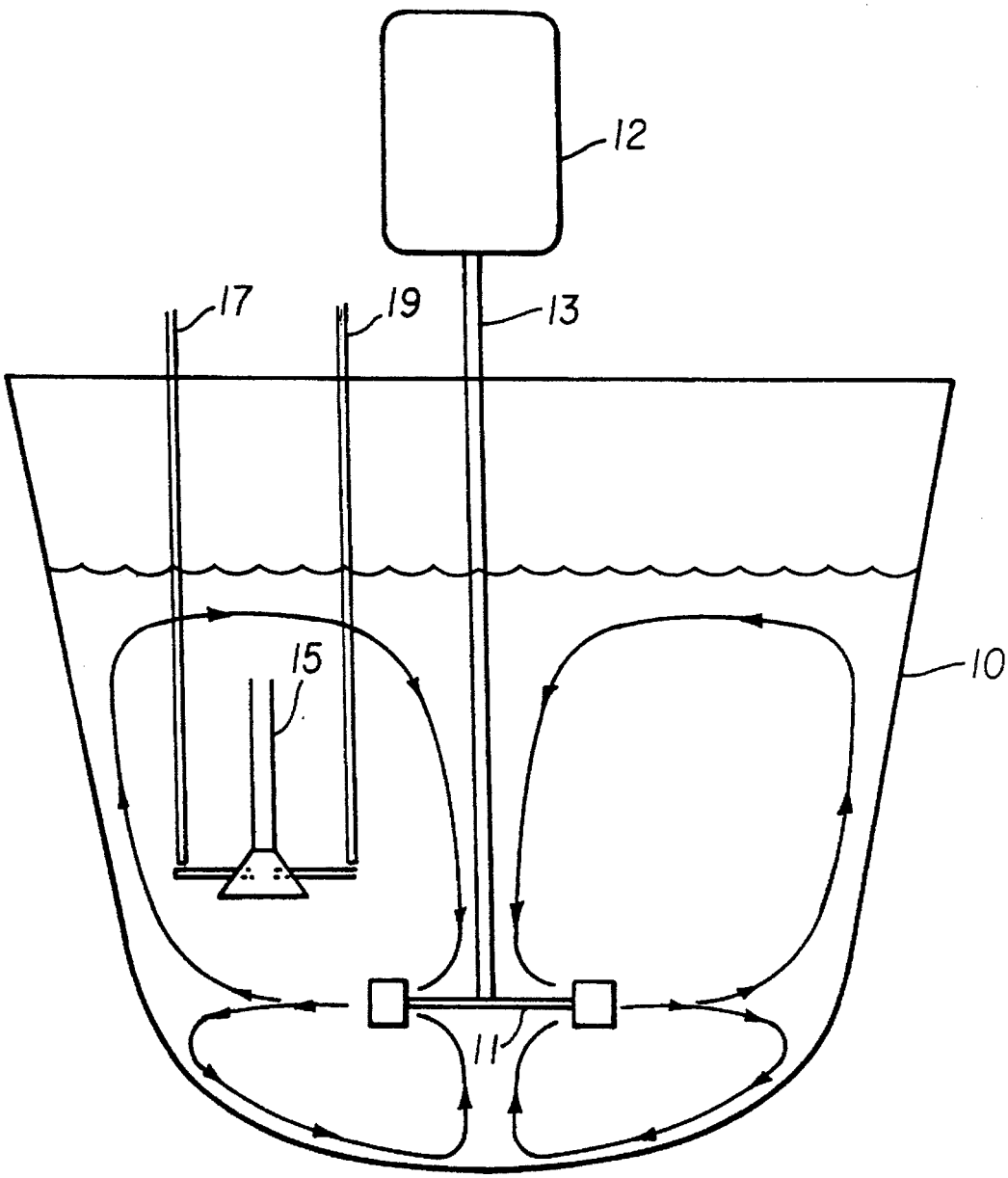
12
17
19
13
15
10
11

SONIC MICRO REACTION ZONES IN SILVER HALIDE EMULSION PRECIPITATION PROCESS

FIELD OF THE INVENTION

The present invention relates to a process for the preparation of photographic silver halide emulsions.

BACKGROUND OF THE INVENTION

The process of silver halide emulsion precipitation is a complex physiochemical phenomenon that is characterized by two competing kinetic processes: a) the kinetics of precipitation; and b) the kinetics of mixing. The kinetics of precipitation may be described by a complex sequence of competitive and consecutive chemical reactions, while the kinetics of mixing is determined by the physical characteristics of the mixer and the hydrodynamics of the medium that is being mixed. In the case of silver halide emulsion precipitation, the medium is a colloidal suspension of water, gelatin and silver halide particles.

In a typical silver halide emulsion precipitation process, aqueous solutions of silver nitrate and alkali halide (NaBr, KI, NaCl, etc.) are introduced into the reactor using a mechanical pump and mixed rapidly by a rotary agitator. The physical characteristics of the silver halide emulsion that results from the precipitation process are determined by the details of the interaction between the physical (mixing) and the chemical (precipitation) processes. The inherent chemical kinetics of the precipitation reaction are extremely rapid, relative to the kinetics of mixing. The chemical reactions that participate in the precipitation process may be regarded as instantaneous phenomena, relative to the sluggish transport of the species participating in the physical process.

The kinetics of mixing can be described by two different rate processes; a) the kinetics of micromixing, which determine the time required to eliminate the microscopic inhomogeneities (by molecular mixing) between regions that have dimensions on the order of the smallest hydrodynamic turbulent length scale in the reactor, and b) the kinetics of macromixing which determine the time required to achieve a homogenous (macroscopic) distribution of the species introduced into the reactor. In the case of silver halide emulsion precipitation, the kinetics of micromixing determine the chemical identity of the precursors to the precipitation process (nucleation and growth), while the kinetics of macromixing are responsible for the homogeneity in the distribution of these precursor species in the reactor. To summarize, both macromixing and micromixing are important in achieving a controlled precipitation of silver halide emulsions.

Generally, during the precipitation of silver halide emulsions, both micromixing and macromixing are achieved using a single rotary agitator. Because the kinetics of micromixing and macromixing are very different, this approach will not provide optimal micromixing and optimal macromixing in the reactor. That is, a single device that is designed to carry out both tasks simultaneously, will necessarily perform one or both of the tasks in less than an optimum manner.

U.S. Pat. No. 4,289,733 addresses this problem by disposing a polygonal mixing chamber within a reaction vessel and using two independently controlled, concentric rotary agitators within the mixing chamber. One of the rotary agitators is used for optimum micromixing and fresh reactants solutions are introduced in close vicinity of this agitator. The other agitator is located slightly above the first agitator and is used for optimum macromixing. One notable feature of this configuration is that there is a high circulation of reactor vessel contents through the reactant introduction region. On one hand, the introduction of reactants to the region of high turbulence is desirable but on the other hand, in many situations, the high circulation of emulsion crystals through that region may prove to be disadvantageous as emulsion crystals may be exposed to regions of high concentration of unreacted reactants and also to high supersaturation levels. Exposure of emulsion crystals to regions of high concentration of unreacted silver salt solution can lead to unintended formation of fog centers. Similarly, exposure to regions of very high supersaturation can lead to undesirable morphological changes such as thickness growth of tabular crystals.

The present invention provides a method and apparatus to improve on the prior art problems. This is done by locating reaction introduction points farther from the macromixing agitator and yet generating efficient micromixing of the reactants by a non-rotary agitation means.

SUMMARY OF THE INVENTION

The present invention is a process for the preparation of a silver halide photographic emulsion. The process includes the steps of introducing an aqueous silver nitrate solution into a first zone and introducing an aqueous halide salt into the first zone. The first zone is mixed using ultrasonic energy wherein the precipitation of silver halide particles occurs. A bulk zone surrounding the first zone containing the mixture of silver halide particles is mixed by a rotary agitator.

The present invention provides superior control of micromixing than provided by prior art teachings. It also provides improved control of the morphology of the emulsion crystals. Finally, improved scalability is achieved because micromixing and macromixing processes are done through two separate devices.

BRIEF DESCRIPTION OF THE DRAWINGS

FIG. 1 shows the apparatus used to perform the method of the present invention.

For a better understanding of the present invention together with other objects and advantages, reference is made to the following detailed description and appended claims in connection with the above described drawings.

DETAILED DESCRIPTION OF THE PREFERRED EMBODIMENTS

The present invention achieves control of macromixing by a rotary agitator that is not enclosed in a mixing chamber. However, the reactant solutions are introduced into the reactor very close to the tip of one or more ultrasonic horns that are placed away from the rotary agitator, i.e., the region of relatively higher circulation rate. Ultrasonic horns are efficient sources for providing regions of high local energy dissipation rate in a liquid medium. Therefore, they serve as the non-rotary means of controlling micromixing. By localizing the ultrasonic horn away from the rotary agitator, the above mentioned disadvantages of the prior art are significantly minimized.

Sonic waves are mechanical disturbances that propagate through fluids by inducing localized density fluctuations in the medium. The magnitude and the frequency of these density fluctuations are determined by the energy and the frequency of the sonic source, which is usually a solid material in contact with the fluid. The sonic source behaves as a point source of spherical waves, the mechanical disturbances (density fluctuations) are radiated in all directions from the source. The transmission of these mechanical disturbances through the fluid occurs at the velocity of sound in the medium, which is about 2,000 m/sec in an aqueous medium. Hence, the regions in the vicinity of the ultrasonic source experience instantaneous density fluctuations, the magnitude which vary continuously at the frequency of the sonic wave. These oscillatory and localized density fluctuations in the fluid give rise to turbulence in the region, which in turn promotes micromixing.

The efficiency of this sonic micromixing phenomena depends on the volume of the reaction zone that requires micromixing, as well as the energy and the frequency of the sonic wave. Optimum micromixing may be achieved by minimizing the volume of the micro reaction zones (MRZs) while maximizing the energy and the frequency of the sonic wave, within the constraints of silver halide emulsion precipitation process. It is also important to minimize the dimensions of the sonic source relative to the MRZ, to optimize its performance as a point source of turbulence in the MRZ. The result of this ultrasonic micromixing approach is the development of a well mixed MRZ in the silver halide precipitation process. Because the micromixing and the macromixing in the reactor are achieved by two independent processes, improved control can be achieved over the generation of precursors to precipitation in the sonic MRZ, as well as the homogeneity and the microscopic distribution of the species in the reactor. Thus, the overall silver halide precipitation process is improved. Scalability of this process is determined by the scalability of two relatively independent phenomena, the scalability of the sonic MRZ and the scalability of macromixing. Hence, the scalability of the process is more linear and more predictable than conventional silver halide emulsion making processes.

One of the embodiments of the present invention includes a single ultrasonic probe. Tip diameter of the probe can be chosen appropriately. The probe can be hollow or solid. In the case of a hollow probe, one or more reagent solutions and/or the suspension in the reactor can be pumped through the ultrasonic probe.

Shown in FIG. 1 is the apparatus used to carry out the present invention. A reactor vessel 10 was used to react to the silver nitrate and halide salt solutions. A rotary agitator 11 attached to a motor 12 through shaft 13 was used to stir the contents of the reactor vessel. An ultrasonic horn 15 (either hollow or solid) was used to create a microreaction zone. Silver nitrate was delivered to the horn 15 through supply line 17 and the halide solution was delivered to the horn through supply line 19. The bulk flow pattern in the reactor vessel is shown generally by the arrows.

EXAMPLE 1

Step 1: An 18 liter reactor vessel containing 5 liters of the solution that is approximately 0.06 molar in sodium bromide and 0.2% in gelatin was maintained at 55° C. and stirred with a turbine-like rotary impeller at a speed of 3000 rpm.

Step 2: To the solution from step 1, 0.5 molar solutions of silver nitrate and sodium bromide were added at a rate of 20 cc/min for 30 min. The reagents were introduced in the highly turbulent region of the mixing impeller.

Step 3: A 5 liter solution containing 2.6% gelatin was added to the suspension from step 2.

Step 4: 1.8 liters each of a 2 molar silver nitrate and a 2 molar silver bromide solution were added to the suspension from steps 3 over a period of one hour. The reagents were again introduced in the same region as step 2.

Step 5: The silver bromide tabular emulsion obtained from this process had an average equivalent circular diameter (ECD) of 1.30 microns and an average thickness of 0.066 microns.

EXAMPLE 2

The emulsion in this example was prepared in the same manner as the emulsion in example 1, but the reagents were added in the bulk region, characterized by relatively low level of turbulence of the reactor. The silver bromide emulsion obtained from this process contained a large population of three dimensional particles and the tabular crystal population was very polydispersed.

EXAMPLE 3

The emulsion in this example was prepared in the same manner as the emulsion in example 2, but the reagent introduction was irradiated with approximately 25 watts of ultrasonic energy. The sodium bromide solution was pumped through the hollow ultrasonic horn. Silver nitrate solution is introduced at the output of horn. The silver bromide tabular emulsion resulting from this process had an average ECD of 1.8 microns and average thickness of 0.066 microns.

EXAMPLE 4

To the suspension contained at the end of step 3 in example 1, solutions containing 3.6 moles of silver nitrate, 3.24 moles of sodium bromide and 0.36 moles of potassium iodine were added over a period of one hour. The reagents were added similarly to example 1. Silver bromoiodide tabular emulsion obtained from this process had an average ECD of 1.14 microns and an average thickness of 0.087 microns.

EXAMPLE 5

The emulsion in this example was prepared in the same manner as the emulsion in example 4, except the solutions containing 3.6 moles of silver nitrate, 3.24 moles of sodium bromide, and 0.36 moles of potassium iodide which were added over a period of one hour, were introduced similarly to example 2. Silver bromoiodide emulsion obtained from this process contained a large population of three dimensional particles.

EXAMPLE 6

The emulsion in this example was prepared in the same manner as the emulsion in example 5 but the reagents introduction was similar to that of example 3. The sodium bromide and the potassium iodide solutions were added over a period of one hour and pumped through the hollow ultrasonic horn. Tabular silver bromoiodide emulsion obtained from this process had an average ECD of 1.29 microns and an average thickness of 0.057 microns.

EXAMPLE 7

The emulsion in this example was prepared in the same manner as the emulsion in example 3, except a solid ultrasonic horn was used. Therefore, the halide salt solution and silver nitrate solution were added close to the tip of the horn. The silver nitrate solution was added further from the tip of the ultrasonic horn. Tabular silver bromide emulsion obtained from this process had an average ECD of 1.02 microns and an average thickness of 0.064 microns.

EXAMPLE 8

The emulsion in this example was prepared in the same manner as the emulsion in example 6, but all the reagents were introduced into the reactor near the tip of a solid ultrasonic horn that provided approximately 25 watts of energy dissipation rate. 0.2% gel solution was also pumped into the reagent introduction region along with the reagents. The tabular silver bromoiodide emulsion obtained from this process had an average ECD 1.10 microns and an average thickness of 0.054 microns.

EXAMPLE 9

Step 1: An 18 liter reactor vessel containing 5 liters of 0.06 molar sodium bromide and 0.2% gelatin at 55° C. was stirred at a rate of 3,000 rpm using a turbine-like rotary agitator. To this vessel was added 0.5 molar silver nitrate and 0.5M sodium bromide at a rate of 20 cc/min for one minute, near the suction side of the rotary agitator.

Step 2: The stirring rate was increased to 6,000 rpm and 1.8 liters of 2 molar silver nitrate, 504 cc of 1.98 molar sodium bromide, 658 cc of 0.5 molar sodium bromide and 1.3 liters of a solution that was 1.38 molar in sodium bromide and 0.6 molar in potassium iodide were added over a period of one hour near the suction side of the rotary agitator.

Step 3: The tabular silver bromoiodide emulsions produced during this process had an average ECD of 0.98 microns and an average thickness of 0.15 microns.

EXAMPLE 10

The emulsion of this example was prepared in the same manner as the example 9, but the reagents added during step 2 of the process were introduced in the bulk region and the reagent introduction region was a radiated with approximately 25 watts of ultrasonic energy, using a solid ultrasonic horn. The tabular silver bromoiodide emulsions produced during this process were characterized to have an average ECD of 0.77 microns and an average thickness of 0.13 microns.

EXAMPLE 11

Step 1: The 6 liter reaction vessel containing 2 liters of a solution of 0.2% gelatin and 0.1 molar of sodium bromide was maintained at 40° C. and stirred at a rate of 500 rpm using a flat blade turbine.

Step 2: To the solution from step 1, solutions of 2 molar silver nitrate and 2 molar sodium bromide were added at a rate of 10 cc/min for one minute, in the bulk region and irradiated with approximately 25 watts of ultrasonic energy using a solid ultrasonic horn.

Step 3: The temperature of the reactor from step 2 was increased to 60° C.

Step 4: 250 cc of a solution that was 10% gelatin and 0.1 molar in sodium bromide was added to the suspension from step 3.

Step 5: To the suspension from step 4, 0.78 moles of 2 molar silver nitrate and 2 molar sodium bromide were added over a period of one hour, under the same ultrasonic and irradiation conditions as in step 3.

Step 6: The silver bromide tabular emulsion obtained from this process had an ECD of 1.87 microns and a thickness of 0.121 microns.

EXAMPLE 12

The emulsion in this example was prepared in the same manner as in example 5, except that the reactor was stirred at a rate of 750 rpm. The silver bromide tabular emulsion obtained from this process had an average ECD of 1.86 microns and a thickness of 0.123 microns.

EXAMPLE 13

The emulsion in this example was prepared in the same manner as in example 6, except that the reactor was stirred at a rate of 1,000 rpm. The silver bromide tabular emulsion obtained from this process had an average ECD of 1.90 microns and a thickness of 0.114 microns.

EXAMPLE 14

The emulsion in this example was prepared in the same manner as in example 5, except that the 2 molar sodium bromide solution was replaced by a solution that was 1.8 molar in sodium bromide and 0.2 molar in potassium iodide. The silver bromoiodide tabular emulsion obtained from this process had an ECD of 1.10 microns and a thickness of 0.119 microns.

EXAMPLE 15

The emulsion in this example was prepared in the same manner as in example 8, except that the reactor was stirred at a rate of 750 rpm. The silver bromoiodide tabular emulsion obtained from this process had an ECD of 1.29 microns and a thickness of 0.104 microns.

EXAMPLE 16

The emulsion in this example was prepared in the same manner as in example 9, except that the reactor was stirred at a rate of 1,000 rpm. The silver bromoiodide tabular emulsion obtained from this process was characterized to have an ECD of 1.28 microns and a thickness of 0.104 microns.

As seen from the above examples, an important consequence of ultrasonic MRZ approach is the ability to create a well mixed sonic micro dual zone process in a conventional precipitation reactor. The sonic MRZ can be regarded as the nucleator (zone 1) generating the subcritical nuclei, which undergo Ostwald ripening in the bulk (zone 2) of the reactor. In principle, the sonic micro dual zone can provide all the established process advantages of the "macro dual zone" process. A unique feature of the present invention is the ability to create multiple nucleators in the precipitation reactor, thus the present process can be used as a multiple zone process. Moreover, the speed of the impeller has little effect on the production of silver halide grains as shown in Examples 15 and 16.

The value of this approach to the silver halide emulsion precipitation process is shown in the examples. The data suggests that iodide does not induce appreciable thickness growth in the AgBrI tabular grains prepared using the present process.

While there has been shown and described what are present and preferred embodiments of the invention, it will be apparent to those skilled in the art the various alterations and modifications may be made herein. All such modifications are intended to be included in the present invention defined by the scope of the following claims.

What is claimed is:

1. A process for the preparation of a silver halide photographic emulsion comprising:

introducing an aqueous silver nitrate solution into a first zone;

introducing an aqueous halide salt solution into the first zone wherein precipitation of silver halide particles occurs;

mixing the first zone using ultrasonic energy wherein the precipitation of silver halide particles occurs forming a mixture of silver halide particles;

mixing a bulk zone surrounding the first zone wherein the mixture of silver halide particles are introduced.

2. The process according to claim 1 wherein the mixing of the bulk zone is performed by a mechanical agitator.

3. The process according to claim 2 wherein the mechanical agitator is a propeller.

4. The process according to claim 2 wherein the mechanical agitator is a centrifugal pump.

* * * * *